US006729863B2

(12) United States Patent
Scholz

(10) Patent No.: US 6,729,863 B2
(45) Date of Patent: May 4, 2004

(54) ROTARY PUMP HAVING HIGH AND LOW PRESSURE PORTS IN THE HOUSING COVER

(75) Inventor: Fritz-Martin Scholz, Hasel (DE)

(73) Assignee: Werner Rietschle GmbH & Co. KG, Schopfheim (DE)

( * ) Notice: Subject to any disclaimer, the term of this patent is extended or adjusted under 35 U.S.C. 154(b) by 0 days.

(21) Appl. No.: 10/305,352

(22) Filed: Nov. 27, 2002

(65) Prior Publication Data

US 2003/0133820 A1 Jul. 17, 2003

Related U.S. Application Data

(63) Continuation-in-part of application No. 09/936,937, filed as application No. PCT/EP00/02536 on Mar. 22, 1999, now abandoned.

(30) Foreign Application Priority Data

Mar. 22, 1999 (DE) ..... 299 05 249 U

(51) Int. Cl.[7] ..... F04C 18/20
(52) U.S. Cl. ..... 418/191; 418/206.4; 418/206.2
(58) Field of Search ..... 418/191, 206.4, 418/206.5, 206.7, 206.2

(56) References Cited

U.S. PATENT DOCUMENTS

| | | | | |
|---|---|---|---|---|
| 2,188,752 A | * | 1/1940 | Houghton | 418/191 |
| 3,023,706 A | | 3/1962 | De Fezzy et al. | |
| 3,989,413 A | * | 11/1976 | McGahan et al. | 418/206.4 |
| 4,057,375 A | | 11/1977 | Nachtrieb | |
| 4,457,680 A | * | 7/1984 | Paget | 418/191 |
| 5,207,568 A | | 5/1993 | Szymaszek | |
| 6,241,490 B1 | * | 6/2001 | Rippl | 418/191 |

FOREIGN PATENT DOCUMENTS

| | | |
|---|---|---|
| AU | 140405 | 12/1949 |
| DE | 84 27 615 | 1/1985 |
| DE | 196 13 659 A1 | 11/1996 |
| EP | 0 048 095 | 8/1981 |
| EP | 0 389 838 | 3/1990 |
| GB | 2 101 687 | 7/1981 |
| GB | 2139287 | 4/1984 |

OTHER PUBLICATIONS

German Office Action dated Dec. 28, 1999 (ihr Zeichen: R 1524 DE).
PCT/ISA/210—International Search Report (R 1524 WO).

* cited by examiner

*Primary Examiner*—John J. Vrablik
(74) *Attorney, Agent, or Firm*—Stuart J. Friedman

(57) ABSTRACT

The pump for generating pressure or negative pressure comprises a pump chamber (32) which has a high-pressure port and a low-pressure port. Two rotors (28, 30) having at least two blades are fitted to two parallel shafts (20, 22) in the pump chamber (32) that are offset to each other, the shafts defining an axial direction. A drive (10) is arranged on an end face of the rotors (28, 30) and a housing cover (34) is arranged on the opposite side. The housing cover (34) is configured cup-shaped and the high-pressure port (42) as well as the low-pressure port (40) are integrated in the housing cover (34). The inner wall (44) of the housing cover (34) delimits the pump chamber (32) on an end face and has two axial openings (46, 48) one each adjoining by one channel (40, 42) which is integrated in the body of the housing cover (34). The axial opening (48) for the high-pressure port, in operation of the pump, is covered by one of the rotors (28, 30) for a time to enable inner compression of the delivered medium.

10 Claims, 3 Drawing Sheets

ROTARY PUMP HAVING HIGH AND LOW PRESSURE PORTS IN THE HOUSING COVER

This is a Continuation-In-Part of application Ser. No. 09/936,937 filed Mar. 18, 2002, abandoned, which is the National Stage of PCT/EP00/02536, filed Mar. 22, 1999.

The invention relates to a pump for generating pressure or negative pressure, and, more particularly to a pump comprising a pump chamber which has a high-pressure port and a low-pressure port, two rotors having at least two blades and fitted to two parallel shafts in the pump chamber that are offset to each other, a drive arranged on an end face of the rotors, and a housing cover arranged on the opposite side.

With pumps of this type, the blades of the rotors engage each other without having any contact, so that a lubricate-free operation is made possible. Hence, there are manifold fields of application for such pumps. Due to the manifold application possibilities of these pumps, an optimization with respect to the size, the weight and the production costs is aimed at.

From U.S. Pat. No. 4,057,375 there is known a positive-displacement pump comprising two blade wheels which rotate in synchronism and with opposite sense of rotation, and the blades of which, due to their meshing engagement, form distinct spaces with changeable volume during the rotary motion; in these spaces, a compressed flow medium is conveyed from the low-pressure side to the high-pressure side, the flow medium being conveyed in a direction perpendicular to the two axes.

Further, in GB 2 139 287 A there is disclosed a hydraulic pump comprising two toothed wheels being in meshing engagement, which are disposed in a chamber into the envelope of which open inlet and outlet channels.

With these known pumps, the rotors are supported on both sides, i.e. on each of the two axle ends. The pump chamber is limited on both end faces by a part of the housing cover. The suction and pressure channels open into the envelope of the pump chamber.

In EP 0 389 838 A2 there is described a rotating piston pump in the form of a roots compressor having two rotors which are arranged cantilevered on two axles being parallel to each other and which make possible the continuous conveying of various incompressible flow media. The rotors are disposed in a chamber which on the side of the gear box is limited by a flat plate—through which the axles of the rotors are passed in a fluid-tight manner—and on the side facing away from the gear box is limited by a housing cover in the envelope of which are arranged—guided radially to the outside—connection ports for inlet and outlet.

The invention provides a pump enabling inner compression of the medium to be delivered, the pump having a space-saving and simple structure and allowing to provide the low-pressure and high-pressure openings on the housing in an end face position.

This is achieved according to the invention in that the housing cover is configured cup-shaped and the high-pressure port as well as the low-pressure port are integrated in the housing cover, the inner wall of the housing cover delimiting the pump chamber on an end face and having two axial openings for the high-pressure and the low-pressure port and the axial openings each being adjoined by one channel which is integrated in the body of the housing cover, the axial opening for the high-pressure port, in operation of the pump, being covered by one of the rotors for a time to enable inner compression of the delivered medium.

Preferably, the axial opening for the high-pressure port is significantly smaller than the axial opening for the low-pressure port. Thus, the opening for the high-pressure port can be easily covered by for a time by one of the rotors with its claw-shaped blades, in contrast to the relatively large opening for the low-pressure port through which medium is continuously delivered into the pump chamber.

Further features and advantages will be apparent from the following description of an advantageous embodiment and the drawing to which reference is made and in which.

FIGS. 7*a* to 7*f* show schematic views of various rotor positions to explain the mode of operation.

Figure 2:
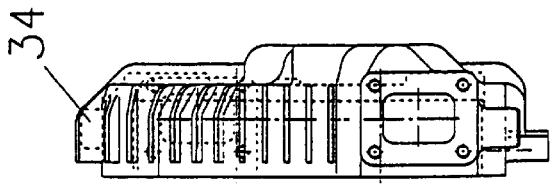
FIG. 2 shows a side view of a housing cover.
Figure 1:
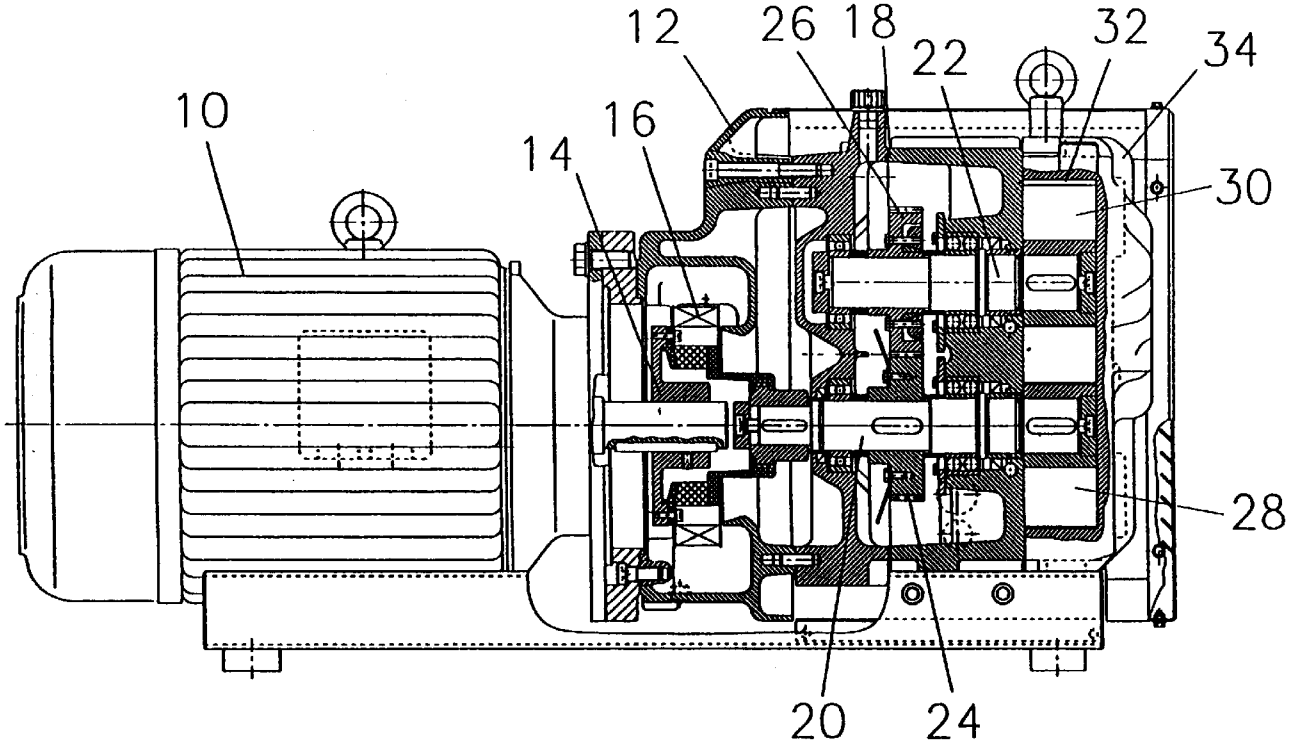
FIG. 1 shows a side view of a pump assembly which is illustrated axially sectioned in the region of the pump section.
Figure 3:
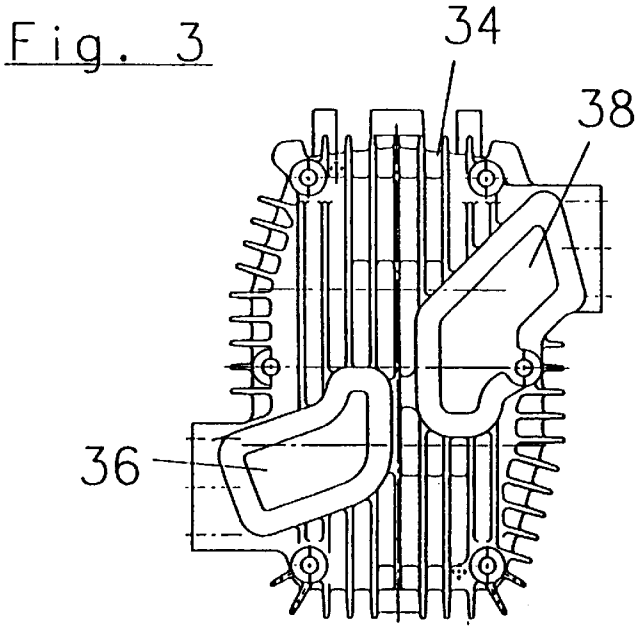
FIG. 3 shows a plan view of the housing cover.
Figure 4:
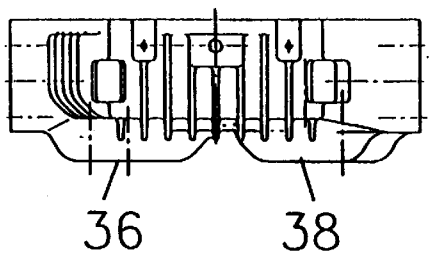
FIG. 4 shows a further side view of the housing cover.
Figure 5:
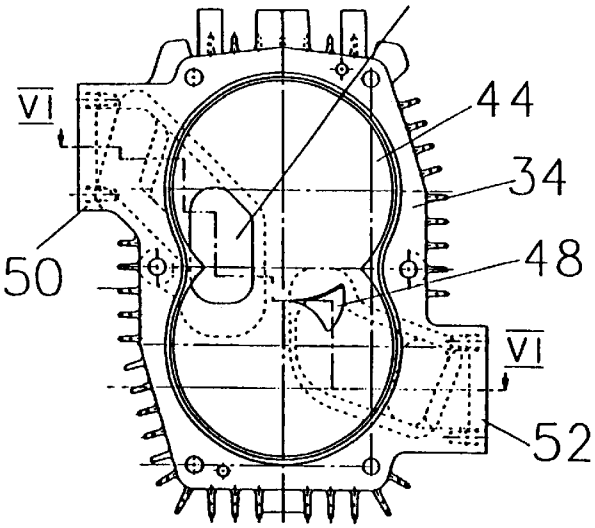
FIG. 5 shows a plan view of the inner side of the housing cover.
Figure 6:
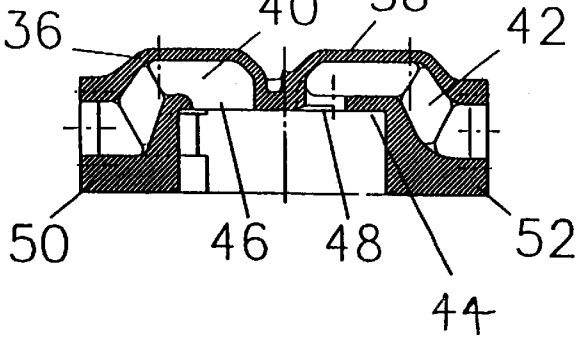
FIG. 6 shows a section along line VI—VI in FIG. 5.

The pump assembly shown in FIG. 1 has a drive in the form of an electric motor 10. The latter is flange-mounted to the side of a fan hood 12. By means of a clutch 14, the electric motor 10 is connected with a fan wheel 16 within the fan hood 12. The fan hood 12 is put on a gear box 18. Two shafts 20, 22 that are parallel and offset to each other are supported on each of their ends in the gear box 18. Two shafts 20, 22 that are parallel and offset to each other are supported on each of their ends in the gear box 18. The shaft 20 is arranged so as to be aligned with the axis of the electric motor 10 and is directly driven by it. A first spur-toothed wheel 24 is mounted on the shaft 20, this first wheel being in meshing engagement with a second spur-toothed wheel 24 mounted on shaft 22.

On those ends of the shafts 20, 22 which are non-supported and facing away from the gear box 18, there is provided one two-blade rotor 28, 30 each. The blades of the rotors 28, 30 are claw-shaped and the geometry of which is designed for inner compression. The mode of operation of the pump assembly will be described in detail with reference to FIGS. 7*a* to 7*f* further below.

The shafts 20, 22 in the gear box 18 run on ball bearings on both sides of the toothed wheels 24, 26, in particular on double-row angular ball bearings, as can be seen from FIG. 1. Thereby, the shafts 20, 22 get a firm guidance and support with respect to the cantilevered mount of the rotors.

The gear box 18 forms with its face facing the rotors 28, 30 a limiting wall on the end face of a pump chamber 32, which for the rest is limited by a cup-shaped housing cover 34 put on the gear box 18. With its flat inner wall 44, the housing cover 34 limits the pump chamber 32 on the side facing away from the gear box 18 and forms the circumferential wall of the pump chamber 32 by means of its envelope.

Integrated in the housing cover 34 are channels forming the high-pressure port and the low-pressure port of the pump. The design of these channels and connections is apparent from FIGS. 2 to 6.

As can be seen in particular from FIGS. 2 to 6, bulges 36, 38 are formed in the end face of the housing cover 34, through which are realized outer limiting walls of two channels 40, 42 integrated in the housing cover. Two axial openings 46, 48 (with respect to the axes of shafts 20, 22) are formed in the flat inner wall 44 of the housing cover 34. The channel 40 starts from opening 46. This channel has a first channel section which extends in parallelism to the inner wall 44, adjoining thereto a channel section which is inclined obliquely in the direction away from the inner wall and inclined outwardly, as well as a channel section adjoining thereto which extends outwardly and in parallelism to the inner wall 44, and opens out at the circumference of the housing cover 34 into a connection flange 50. The opening 48 is adjoined by channel 42 which likewise has a first channel section which extends in parallelism to the inner wall 44, a channel section adjoining thereto which is inclined obliquely outwardly towards the drive side, as well as a channel section again extending in parallelism to the inner wall 44, and opening out at the circumference of the housing cover 34 into a connection flange 52. The connection flanges 50, 52 are situated on sides of the housing cover facing away from each other and are at different levels Due to the cantilevered support of the rotors 28, 30 there remains available, in the region of the free ends of the shafts 22, 24, a space for an optimum design of the channels 40, 42. The channels 40, 42 can be designed in particular with respect to optimum flow conditions and favorable connection conditions.

Figure 7A:
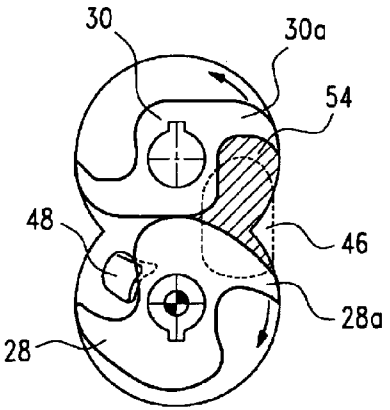
Figure 7B:
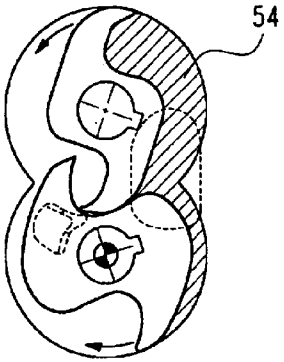

In FIGS. 7*a* to 7*f* several positions of the rotors 28, 30 during one cycle of the pump assembly are illustrated. FIG. 7*a* shows the rotors 28, 30 in a rotating position in which their blades 28*a*, 30*a* together with the wall of the pump chamber 32 define a closed joint cell 54 that is only connected to the low-pressure opening 46. The volume of this cell 54 increases during the further rotation of the rotors 28, 30 as can be seen in FIG. 7*b*. Thus, the cell 54 is a suction cell.

Figure 7C:
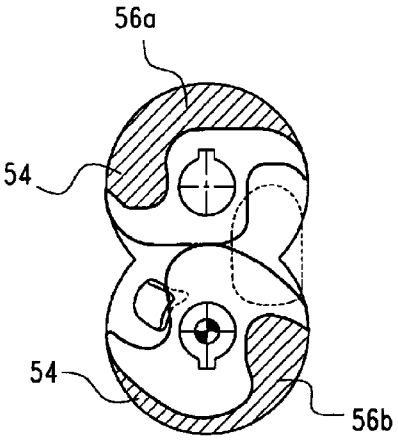
Figure 7D:
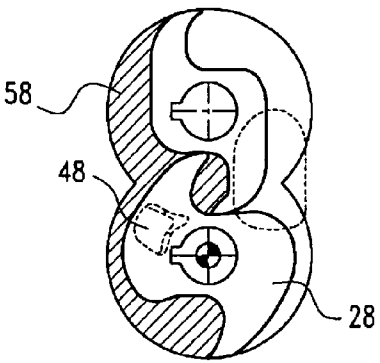
Figure 7E:
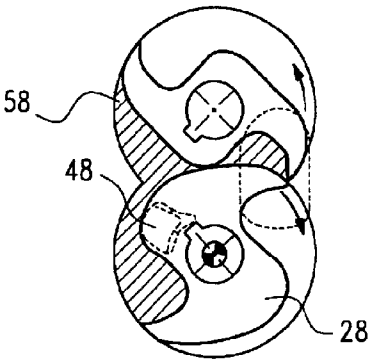
Figure 7F:
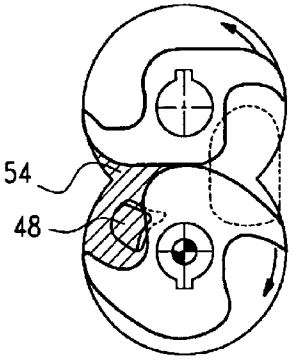

FIG. 7*c* shows two cells 56*a*, 56*b* separate from each other, which are formed after the state shown in FIG. 7*b* when the cell 54 was separated into two partial cells. The cells 56*a*, 56*b* are shifted (FIG. 7*c*) until, as shown in FIG. 7*d* they unite with each other to define a pressure cell 58. During the phase in which the high-pressure opening 48 is completely covered by rotor 28 (FIGS. 7*d*, 7*e*) the decrease of the volume of the pressure cell 56 provides an inner compression as the delivered medium cannot escape through the high-pressure opening 48. By further rotation of the rotors 28, 30 the medium compressed in the pressure cell 58 is then pushed out via the high-pressure opening 48, which is significantly smaller than the low-pressure opening 46, as illustrated in FIG. 7*f*.

The provision of axial openings 46, 48 for the high-pressure and low-pressure ports significantly facilitates the inner compression of the delivered medium because no further means apart from the claw-shaped rotors 28, 30 are required to cover or uncover the openings 46, 48. Thus, a compact design of the pump assembly is enabled.

I claim:

1. A pump for generating pressure or negative pressure, comprising a pump chamber (32) which has a high-pressure port and a low-pressure port; two rotors (28, 30) having at least two blades and fitted to two parallel shafts (20, 22) in the pump chamber (32) that are offset to each other, the shafts (20, 22) defining an axial direction; a drive (10) arranged on an end face of the rotors (28, 30) and a housing cover (34) arranged on the opposite side, the housing cover (34) being configured cup-shaped and the high-pressure port as well as the low-pressure port being integrated in the housing cover (34), wherein the inner wall (44) of the housing cover (34) delimits the pump chamber (32) on an end face and has two axial openings (46, 48) for the high-pressure port and the low-pressure port and the axial openings (46, 48) are each adjoined by one channel (40, 42) which is integrated in the body of the housing cover (34), at least one of the channels (40, 42) leading to the circumference of the housing cover (34) and opening out there, the axial opening (48) for the high-pressure port, in operation of the pump, being covered by one of the rotors (28, 30) for a time to enable inner compression of the delivered medium.

2. The pump according to claim 1, wherein the axial opening (48) for the high-pressure port is significantly smaller than the axial opening (46) for the low-pressure port.

3. The pump according to claim 1, wherein the axial openings (46, 48) are positioned in the central area of said pump chamber (32).

4. The pump according to claim 1, wherein the channel (40, 42) has a first channel section extending in parallelism to the inner wall (44) of the housing cover (34), adjoining thereto a channel section which is inclined obliquely in the direction away from the inner wall (44) and inclined outwardly, and adjoining thereto a channel section which opens out at the circumference of the housing cover (34) and is parallel to the inner wall (44) thereof.

5. The pump according to claim 1, wherein the blade geometry of the rotors (28, 30) is designed for inner compression.

6. The pump according to claim 1, wherein at least a substantial part of the circumferential wall of the pump chamber (32) is formed by the envelope of the housing cover (34).

7. The pump according to claim 1, wherein two connection flanges (50, 52) are formed on the circumference of the housing cover (34) at two sides facing away from each other.

8. The pump according to claim 7, wherein the connection flanges (50, 52) are vertically offset to each other.

9. The pump according to claim 1, wherein the shafts (20, 22) are supported on one side, which is the side that faces the drive (10).

10. The pump according to claim 9, wherein the shafts (20, 22) are each supported on both sides of a toothed wheel (24, 26).

* * * * *